US008237362B2

(12) United States Patent
Kim et al.

(10) Patent No.: US 8,237,362 B2
(45) Date of Patent: Aug. 7, 2012

(54) PLASMA DISPLAY PANEL AND METHOD OF MANUFACTURING THE SAME

(75) Inventors: Hyun-Chul Kim, Suwon-si (KR); Hyoung-Bin Park, Suwon-si (KR); Sang-Hyuck Ahn, Suwon-si (KR); Sang-Ho Jeon, Suwon-si (KR); Seung-Hyun Son, Suwon-si (KR); Gi-Young Kim, Suwon-si (KR); Sil-Keun Jeong, Suwon-si (KR); Sung-Hyun Choi, Suwon-si (KR); Jung-Min Kim, Suwon-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 0 days.

(21) Appl. No.: 12/589,750

(22) Filed: Oct. 27, 2009

(65) Prior Publication Data

US 2010/0207510 A1 Aug. 19, 2010

Related U.S. Application Data

(60) Provisional application No. 61/153,242, filed on Feb. 17, 2009.

(51) Int. Cl.
*H01J 17/49* (2012.01)

(52) U.S. Cl. ..... 313/582; 313/586; 313/587; 313/292

(58) Field of Classification Search ..... 313/582–587, 313/292, 609
See application file for complete search history.

(56) References Cited

U.S. PATENT DOCUMENTS 6,603,263 B1 8/2003 Hashimoto et al.
2001/0050534 A1 * 12/2001 Amemiya et al. ..... 313/586
(Continued)

FOREIGN PATENT DOCUMENTS

EP 1 788 607 A2 5/2007
(Continued)

OTHER PUBLICATIONS

European Search Report dated Jun. 16, 2010, for corresponding European Patent application 09251729.1, noting listed references in this IDS.

(Continued)

*Primary Examiner* — Karabi Guharay
*Assistant Examiner* — Kevin Quarterman
(74) *Attorney, Agent, or Firm* — Christie, Parker & Hale, LLP

(57) ABSTRACT

A plasma display panel (PDP) and a method of manufacturing the same with improved luminous efficiency. The PDP includes: a first substrate; a second substrate facing the first substrate; a plurality of sustain electrode pairs between the first substrate and the second substrate and extending in a first direction; a plurality of address electrodes on the second substrate and extending in a second direction crossing the first direction; a first dielectric layer on the second substrate for covering the address electrodes; a discharge enhancement layer on the first dielectric layer; a plurality of barrier ribs on the discharge enhancement layer and defining discharge cells between the first and second substrates; and phosphor layers in the discharge cells, wherein the discharge enhancement layer has an opening in each of the discharge cells, and wherein the barrier ribs have a roughness less than that of the discharge enhancement layer.

21 Claims, 11 Drawing Sheets
(2 of 11 Drawing Sheet(s) Filed in Color)

U.S. PATENT DOCUMENTS

| | | | | |
|---|---|---|---|---|
| 2004/0189199 | A1* | 9/2004 | Komaki et al. | 313/582 |
| 2005/0073254 | A1* | 4/2005 | Masuda et al. | 313/584 |
| 2005/0179384 | A1* | 8/2005 | Kwon et al. | 313/583 |
| 2005/0218805 | A1* | 10/2005 | Kitagawa et al. | 313/582 |
| 2005/0242696 | A1* | 11/2005 | Song | 313/292 |
| 2005/0242726 | A1* | 11/2005 | Mizuta | 313/582 |
| 2005/0264197 | A1* | 12/2005 | Yoshinari et al. | 313/582 |
| 2006/0082303 | A1 | 4/2006 | Song | |
| 2007/0120486 | A1 | 5/2007 | Jang et al. | |
| 2008/0079366 | A1 | 4/2008 | Kim | |
| 2008/0174245 | A1 | 7/2008 | Soh et al. | |
| 2008/0211407 | A1* | 9/2008 | Song | 313/582 |
| 2009/0128035 | A1 | 5/2009 | Nam et al. | |
| 2009/0153049 | A1* | 6/2009 | Horiuchi et al. | 313/582 |
| 2009/0184639 | A1* | 7/2009 | Kwon et al. | 313/582 |

FOREIGN PATENT DOCUMENTS

| | | | |
|---|---|---|---|
| JP | 2001-023515 | | 1/2001 |
| KR | 10-1999-0075037 | | 10/1999 |
| KR | 10-2001-0026890 | | 4/2001 |
| KR | 10-2001-0026890 | A | 4/2001 |
| KR | 10-2001-0039033 | | 5/2001 |
| KR | 10-2001-0039033 | A | 5/2001 |
| KR | 10-2004-0076969 | | 9/2004 |
| KR | 10-2005-0088535 | | 9/2005 |
| KR | 10-2006-0110961 | | 10/2006 |
| KR | 10-2007-0102249 | | 10/2007 |
| KR | 10-2008-0069863 | | 7/2008 |

OTHER PUBLICATIONS

European Office action dated May 13, 2011, for corresponding European Patent application 09251729.1, 5 pages.

U.S. Notice of Allowance dated Mar. 8, 2012, for cross reference U.S. Appl. No. 12/902,076, 9 pages.

U.S. Office action dated Jun. 22, 2011, for cross reference U.S. Appl. No. 12/870,771, 13 pages.

U.S. Office action dated Nov. 18, 2011, for cross reference U.S. Appl. No. 12/870,771, 13 pages.

U.S. Office action dated Nov. 10, 2011 for cross reference U.S. Appl. No. 12/902,076, 11 pages.

KIPO Registration Determination Certificate dated Sep. 26, 2011, for Korean Patent application 10-2009-0104303, 6 pages.

* cited by examiner

PLASMA DISPLAY PANEL AND METHOD OF MANUFACTURING THE SAME

CROSS-REFERENCE TO RELATED APPLICATION

This application claims priority to and the benefit of U.S. Provisional Patent Application No. 61/153,242, filed Feb. 17, 2009, the entire content of which is incorporated herein by reference.

BACKGROUND OF THE INVENTION

1. Field of the Invention

The present invention relates to a plasma display panel (PDP) and a method of manufacturing the same, and more particularly, to a PDP with improved luminous efficiency and a method of manufacturing the PDP.

2. Description of Related Art

A plasma display panel (PDP) includes a front substrate, a rear substrate, discharge electrodes disposed between the front substrate and the rear substrate to cross each other, barrier ribs defining a plurality of discharge cells, a phosphor layer applied to inner walls of the discharge cells, and a discharge gas sealed in the discharge cells. The above described PDP produces a desired image by applying discharge pulses (e.g., predetermined discharge pulses) to the discharge electrodes in the respective discharge cells to generate ultraviolet rays that excite red, green and/or blue (RGB) phosphors to generate visible light.

In order to improve the luminous efficiency of the PDP, brightness should be increased while power consumption should be reduced. Various efforts have been made to improve luminous efficiency. One of the efforts is to improve light extraction efficiency from the phosphors in the discharge cells. For example, attempts to improve driving efficiency and enhance discharge performance by using complex discharge cell structure have recently been made. However, in a PDP having the complex discharge cell structure, there is a need to improve luminous efficiency through the proper application of phosphors to the discharge cells.

SUMMARY OF THE INVENTION

Embodiments of the present invention are directed toward a plasma display panel (PDP) with improved luminous efficiency by properly applying phosphors to inner walls of discharge cells in a manner that are designed to improve driving efficiency and enhance discharge performance, and a method of manufacturing the PDP.

According to an embodiment of the present invention, there is provided a plasma display panel (PDP) including: a first substrate; a second substrate facing the first substrate; a plurality of sustain electrode pairs between the first substrate and the second substrate and extending in a first direction; a plurality of address electrodes on the second substrate and extending in a second direction cross the first direction of the sustain electrode pairs; a first dielectric layer on the second substrate for covering the plurality of address electrodes; a discharge enhancement layer on the first dielectric layer; a plurality of barrier ribs on the discharge enhancement layer and defining discharge cells between the first substrate and the second substrate; and phosphor layers in the discharge cells, wherein the discharge enhancement layer has an opening in each of the discharge cells, and wherein the barrier ribs have a roughness less than that of the discharge enhancement layer.

A distance between two adjacent ones of the barrier ribs facing each other in a direction parallel to a surface of the first substrate or the second substrate may be greater than a width of a corresponding one of the openings. The discharge enhancement layer may have a brightness greater than that of the barrier ribs. The discharge enhancement layer may have a reflectance greater than that of the barrier ribs.

The phosphor layers may be on side surfaces of the barrier ribs, a top surface of the discharge enhancement layer, and/or in the openings. A width of each of the openings may taper toward the first dielectric layer. The distance between two adjacent ones of the barrier ribs may taper toward the first dielectric layer. A side surface of the discharge enhancement layer defining one of the openings may have a slope with an angle between about 7° and about 30° with respect to a surface substantially perpendicular to the first substrate or the second substrate.

Each of the sustain electrode pairs may include an X electrode and a Y electrode on the first substrate, the X electrode and the Y electrode being spaced apart from each other.

The plasma display panel may further include a second dielectric layer on the first substrate and covering the sustain electrode pairs, and a protective layer on the second dielectric layer.

A portion of a top surface of the discharge enhancement layer in a first discharge cell of the discharge cells may have a first width extending in the first direction and a second width extending in the second direction, the first and second directions being parallel to the first substrate or the second substrate. A ratio of the first width to a width of the first discharge cell extending in the first direction may be greater than a ratio of the second width to another width of the first discharge cell extending in the second direction, the first and second directions being substantially perpendicular to each other.

The barrier ribs may include first barrier ribs extending in the first direction and second barrier ribs extending in the second direction. The first barrier ribs and the second barrier ribs may define only the discharge cells. The first barrier ribs and the second barrier ribs may define the discharge cells and non-discharge cells between the first substrate and the second substrate.

The openings of the discharge enhancement layer in the respective discharge cells may have rounded corners. A curvature of corners of the openings in the discharge cells may be different from that of other openings of the discharge enhancement layer in the non-discharge cells. A curvature of corners of the openings in the discharge cells may be smaller than that of other openings of the discharge enhancement layer in the non-discharge cells. The discharge enhancement layer may have other openings in the non-discharge cells.

The phosphor layers may be in contact with the first dielectric layer in the non-discharge cells via the other openings. The discharge enhancement layer may have no opening in the non-discharge cells. The phosphor layers may not be in the non-discharge cells.

According to an embodiment of the present invention, a method of manufacturing a plasma display panel is provided. According to the method, a plurality of sustain electrode pairs are formed on a first substrate facing a second substrate, the sustain electrode pairs extending in a first direction. A plurality of address electrodes are formed on the second substrate, the address electrodes extending in a second direction crossing the first direction. A first dielectric layer is formed on the second substrate for covering the plurality of address electrodes. A discharge enhancement layer is formed on the first dielectric layer. A barrier rib layer is formed on the discharge enhancement layer. A plurality of barrier ribs are formed on the discharge enhancement layer, the barrier ribs defining a plurality of discharge cells between the first and second substrates. Openings are formed in the discharge enhancement layer in the discharge cells. Phosphor layers are formed in the discharge cells. The barrier ribs have a roughness less than that of the discharge enhancement layer.

A distance between two adjacent ones of the barrier ribs facing each other in a direction parallel to a surface of the first substrate or the second substrate may be greater than a width of a corresponding one of the openings.

The barrier ribs and the openings of the discharge enhancement layer may be formed at the same time. The barrier ribs may be composed of a first material and the discharge enhancement layer may be composed of a second material, and the first material and the second material may be photosensitive.

Since phosphors are substantially uniformly applied to inner walls of the discharge cells that are defined by both barrier ribs and a discharge enhancement layer, a plasma display panel (PDP) and a method of manufacturing the same according to the embodiments of the present invention can improve luminous efficiency. Since light extraction efficiency is improved due to the slope of a phosphor layer, the PDP and the method of manufacturing the same according to the embodiments of the present invention can improve luminous efficiency. Furthermore, since the same number of priming particles can be produced with a lower address voltage due to the discharge enhancement layer as compared to a conventional art, the PDP and the method of manufacturing the same according to the embodiments of the present invention can reduce driving power consumption and improve luminous efficiency. Since the brightness of the discharge enhancement layer is greater than that of the barrier ribs, the PDP and the method of manufacturing the same according to the embodiments of the present invention can increase a reflectance of visible light emitted from the phosphor layer and improve luminous efficiency.

BRIEF DESCRIPTION OF THE DRAWINGS

The patent or application file contains at least one drawing/picture executed in color. Copies of this patent or patent application publication with color drawing/picture(s) will be provided by the Office upon request and payment of the necessary fee.

Figure 1:
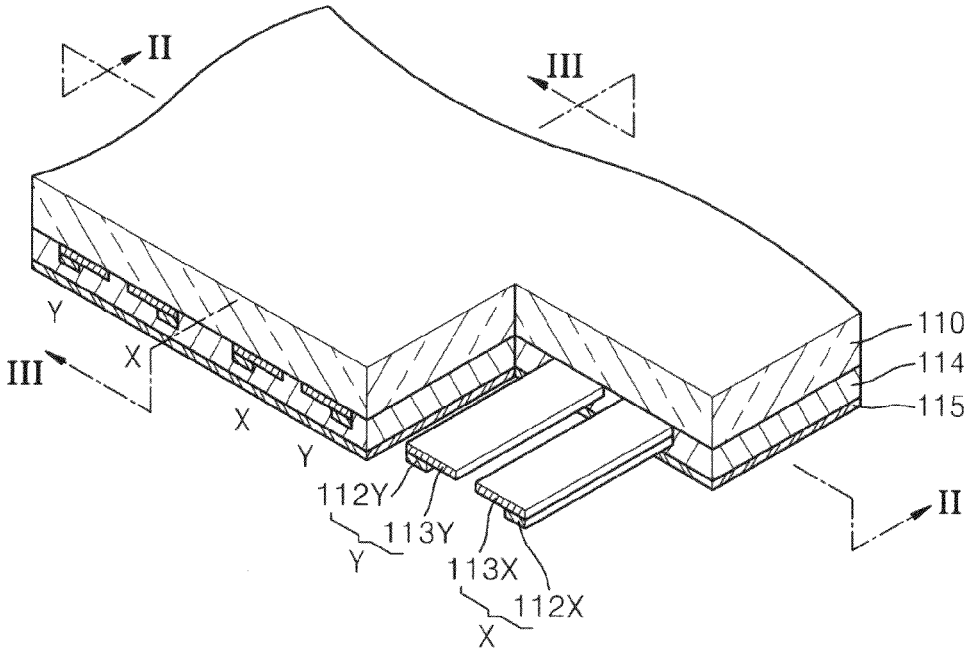
FIG. 1 is a partial exploded perspective schematic view of a plasma display panel (PDP) according to an embodiment of the present invention.
Figure 1:
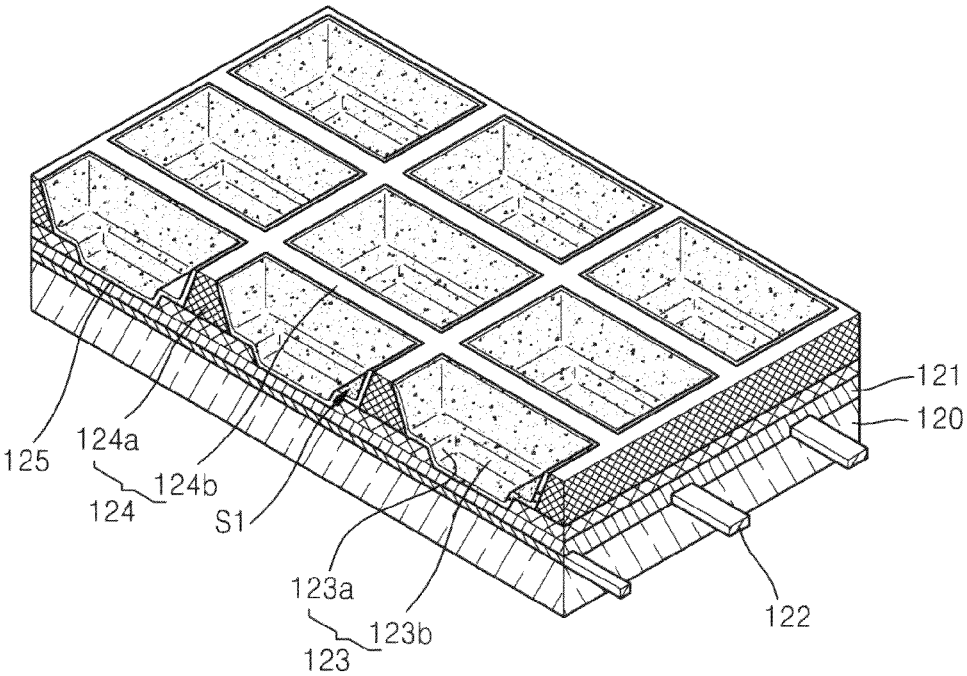

Explanation of Reference numerals designating certain Elements of the Drawings:

110, 210, 310: Front substrate
112, 212, 312: Bus electrode
113, 213, 313: Transparent electrode
114, 214, 314: Front dielectric layer
115, 215, 315: Protective layer
120, 220, 320: Rear substrate
121, 221, 321: Rear dielectric layer
122, 222, 322: Address electrode
123*a*, 123*b*, 223*a*, 223*b*, 323*a*: Discharge enhancement layer
123*aa*, 123*ba*: Groove of discharge enhancement layer
124*a*, 224*a*, 324*a*: Horizontal barrier rib
124*b*, 224*b*: Vertical barrier rib
125, 225, 325: Phosphor layer

DETAILED DESCRIPTION OF EXEMPLARY EMBODIMENTS

The present invention will now be described more fully with reference to the accompanying drawings, in which exemplary embodiments of the invention are shown.

Figure 2:
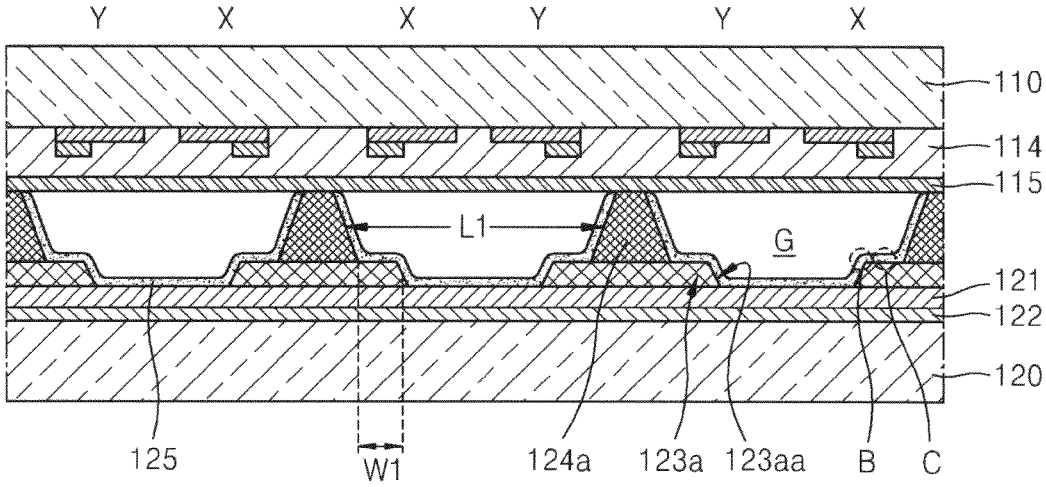
FIG. 2 is a cross-sectional schematic view taken along the line II-II of FIG. 1.
Figure 3:
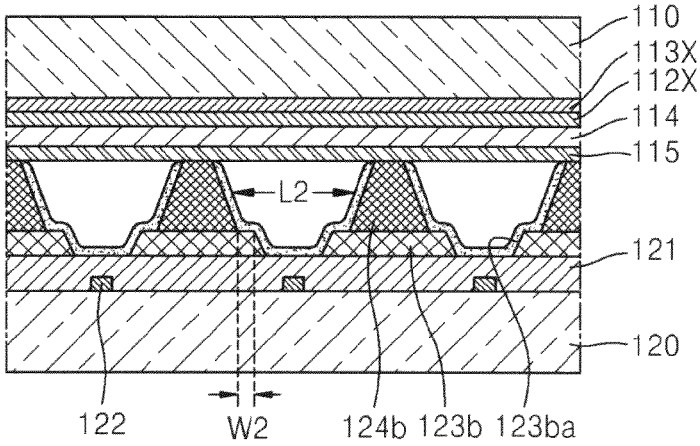
FIG. 3 is a cross-sectional schematic view taken along the line III-III of FIG. 1.

FIG. 1 is a partial exploded perspective schematic view of a plasma display panel (PDP) according to an embodiment of the present invention. FIG. 2 is a cross-sectional schematic view taken along the line II-II of FIG. 1. FIG. 3 is a cross-sectional schematic view taken along the line III-III of FIG. 1.

Referring to FIGS. 1 through 3, the PDP includes a front panel and a rear panel. The front panel and the rear panel are sealed together with a plurality of discharge cells G in between, and the discharge cells G are filled with a discharge gas. The front panel may include a front (or first) substrate 110, a plurality of sustain electrode pairs, a front dielectric layer 114, and a protective layer 115. The rear panel may include a rear (or a second) substrate 120, a plurality of address electrodes 122, a rear dielectric layer 121, a discharge enhancement layer 123 including a horizontal discharge enhancement layer 123*a* and a vertical discharge enhancement layer 123*b*, barrier ribs 124 including horizontal barrier ribs 124*a* and vertical barrier ribs 124*b*, and a phosphor layer 125.

The PDP produces an image by exciting phosphors with the discharge gas filled in the discharge cells G, which are arranged in rows and columns, to emit visible light. In FIGS. 1 and 2, the dimensions of the discharge cells G are vertically defined by the front substrate 110 and the rear substrate 120 in a direction perpendicular to the front substrate 110, and are defined by the barrier ribs 124 and the discharge enhancement layer 123 in a lateral direction parallel to the front substrate 110.

Each of the sustain electrode pairs includes a common electrode X and a scan electrode Y which form one pair of electrodes to generate a sustaining discharge therebetween. In more detail, each of the sustain electrode pairs includes transparent electrodes 113X and 113Y and bus electrodes 112X and 112Y. The transparent electrodes 113X and 113Y generate a sustaining discharge in each of the discharge cells G, and the bus electrodes 112X and 112Y are respectively in contact with the transparent electrodes 113X and 113Y in order to account for a low electric conductivity of the transparent electrodes 113X and 113Y. A black stripe may be further formed on a portion between two adjacent sustain electrode pairs which corresponds to a horizontal barrier rib. The black stripe absorbs external light to improve bright room contrast.

Although the sustain electrode pairs are formed on the front substrate 110 in FIG. 1, the present invention is not limited thereto, and the sustain electrode pairs may be formed on other suitable places other than on the front substrate 110. For example, the sustain electrode pairs may be formed in the barrier ribs 124. In one embodiment of the present invention, when there are two adjacent barrier ribs with a discharge space therebetween, a common electrode X may be covered by a side of one horizontal barrier rib of the two adjacent barrier ribs, and a scan electrode Y may be covered by a side of the other barrier rib of the two adjacent barrier ribs facing the side of the one horizontal barrier rib.

The front dielectric layer 114 is formed on the front substrate 110 to cover the sustain electrode pairs. The front dielectric layer 114, which is formed of an insulating material, acts as a condenser during a discharge. Further, the front dielectric layer 114 limits current, and performs a memory function to form wall charges. The protective layer 115 is formed on the front dielectric layer 114 to protect the front of the dielectric layer 114 from a discharge. The protective layer 115 may be formed of magnesium oxide (MgO).

In FIGS. 1 and 2, the address electrodes 122 are disposed on the rear substrate 120. The address electrodes 122 are operated with the scan electrodes Y to generate an addressing discharge. Here, the addressing discharge refers to a discharge that precedes a sustaining discharge and assists the sustaining discharge by accumulating priming particles in each of the discharge cells G.

The rear dielectric layer 121 is disposed on the rear substrate 120 to cover the address electrodes 122. The horizontal discharge enhancement layer 123*a* and the vertical discharge enhancement layer 123*b* of the discharge enhancement layer 123 are formed on the rear dielectric layer 121. FIG. 2 illustrates a cross-sectional schematic view of the PDP of FIG. 1 in a horizontal direction of the PDP in which the sustain electrode pairs extend. Openings (e.g., grooves) 123*aa* are formed in portions of the horizontal discharge enhancement layer 123*a* corresponding to centers of the discharge cells G to expose central portions of the rear dielectric layer 121 to discharge spaces. Here, the above described feature that refers to some portions of the rear dielectric layer 121 being exposed to the discharge spaces refers to the portions of the rear dielectric layer 121 corresponding to the openings 123*aa* are exposed to the discharge spaces before the phosphor layer 125 is formed, not meaning that the portions of the rear dielectric layer 121 corresponding to the openings 123*aa* that are exposed to the discharge spaces after the phosphor layer 125 is formed.

Each of the side surfaces defining each of the openings 123*aa* may have a set or predetermined slope at an angle α with respect to a surface substantially perpendicular to the first substrate or the second substrate. The angle α may be between about 7° and about 30°. The size of each of the openings 123*aa* defined by the side surfaces of each of the openings 123*aa* may taper toward the rear dielectric layer 121. A method of forming the openings 123*aa* and the effect of the slope of each of the side surfaces of each of the openings 123*aa* will be explained later in more detail.

Likewise, referring to FIG. 3 illustrating a cross-sectional schematic view in a vertical direction of the PDP in which the address electrodes 122 extend, openings (e.g., grooves) 123*ba* are formed in portions of the vertical discharge enhancement layer 123*b* corresponding to centers of the discharge cells G to expose some portions of the rear dielectric layer 121 to the phosphor layer 125 in the discharge spaces. The width W2 of a front surface of the vertical discharge enhancement layer 123*b* may be much less than the width W1 (shown in FIG. 2) of a front surface of the horizontal discharge enhancement layer 123*a*.

The discharge enhancement layer 123 may be made of a dielectric material suitable for forming a high electric field of addressing discharge in an auxiliary discharge space S1 (shown in FIG. 1).

The horizontal barrier ribs 124*a* and the vertical barrier ribs 124*b* are respectively formed on the horizontal discharge enhancement layer 123*a* and the vertical discharge enhancement layer 123*b*. The horizontal barrier ribs 124*a* are formed on portions of the horizontal discharge enhancement layer 123*a* where the openings 123*aa* are not formed. The vertical barrier ribs 124*b* are formed on portions of the vertical discharge enhancement layer 123*b* where the openings 123*ba* are not formed. When being seen in the horizontal direction, since the width (vertical extent) of each of the horizontal barrier ribs 124*a* is less than the width (vertical extent) of the horizontal discharge enhancement layer 123*a*, the width of the discharge space in the horizontal direction increases toward the front dielectric layer 114. Each of the side surfaces of each of the horizontal barrier ribs 124*a* may have a set or predetermined slope with an angle α with respect to a surface substantially perpendicular to the first substrate or the second substrate. The angle α may be between about 7° and about 30°. (See FIG. 10). A method of forming each of the side surfaces of each of the horizontal barrier ribs 124*a* as inclined surface and the effect of the slope of each of the side surfaces of each of the horizontal barrier ribs 124*a* will be explained later in more detail.

The slope of each of the side surfaces of each of the horizontal barrier ribs 124*a* and the slope of each of the side surfaces of the horizontal discharge enhancement layer 123*a* may be the same or different.

In FIG. 1, the barrier ribs 124 include the horizontal barrier ribs 124*a* and the vertical barrier ribs 124*b*. The vertical dimensions of the discharge cells G are defined by the horizontal barrier ribs 124*a*. In the embodiment shown in FIG. 2, the bus electrodes 112X and 112Y are not located at regions corresponding to the horizontal barrier ribs 124*a* but are located at offset regions toward the centers of the discharge cells G.

Figure 4:
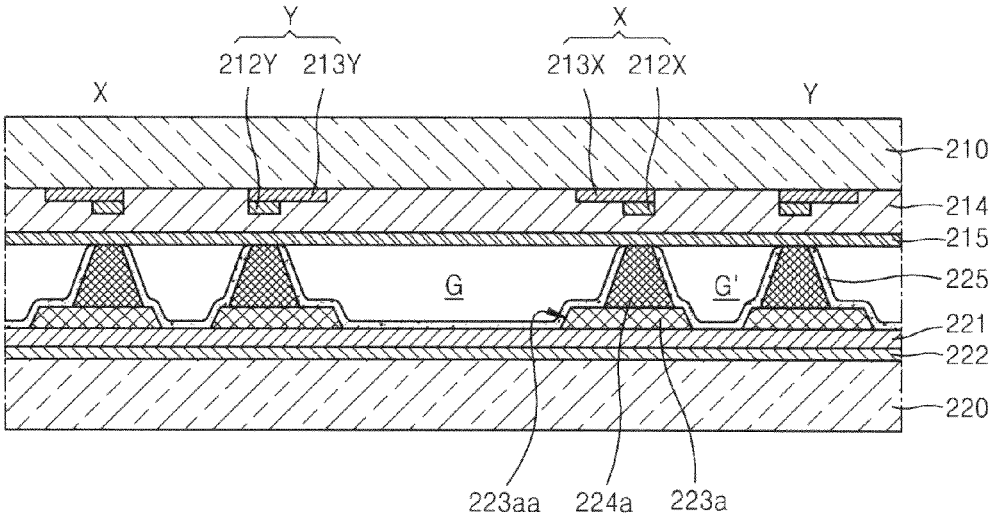
FIG. 4 is a cross-sectional schematic view of a PDP, in the same direction as that of FIG. 2, according to another embodiment of the present invention.
Figure 5:
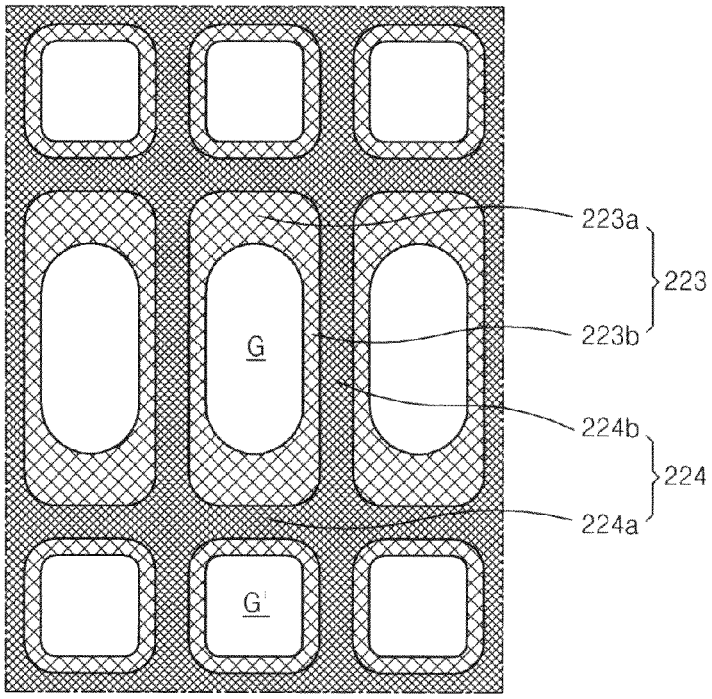
FIG. 5 is a plan schematic view of a rear panel of the PDP of FIG. 4.

FIG. 4 is a cross-sectional schematic view of a PDP, taken in the same direction as that of FIG. 2, according to another embodiment of the present invention. FIG. 5 is a plan schematic view of a rear panel of the PDP of FIG. 4. Referring to FIGS. 4 and 5, barrier ribs 224 include horizontal barrier ribs 224*a* and vertical barrier ribs 224*b*, and the vertical dimensions of discharge cells G and non-discharge cells G' are defined by the horizontal barrier ribs 224*a* in a vertical direction. That is, the horizontal barrier ribs 224*a* may be configured such that one non-discharge cell G' is disposed between two discharge cells G in the vertical direction. In FIGS. 4 and 5, bus electrodes 212X and 212Y may be located in regions corresponding to the horizontal barrier ribs 224*a*.

In the embodiment of FIG. 5, a curvature of the corners of the openings in the discharge cells G may be different from that of other openings of the discharge enhancement layer in the non-discharge cells G'. For example, a curvature of the corners of the openings in the discharge cells G is smaller than that of the openings of the discharge enhancement layer in the non-discharge cells G'.

In one embodiment of the present invention, a second material for forming a discharge enhancement layer 223 and a first material for forming the barrier ribs 224 are photosensitive. Also, the first material and the second material are suitably selected so that each of the horizontal barrier ribs 224*a* has a roughness (or surface roughness) that is less than that of the horizontal discharge enhancement layer 223*a*. Since suitable compositions of the first material and the second material are different from each other, the roughnesses of the horizontal discharge enhancement layer 223*a* and the horizontal barrier ribs 224*a* may be different from each other. In another embodiment, the compositions of the first material and the second material are the same, but composition ratios of the first material and the second material are different from each other, therefore the roughnesses of the horizontal discharge enhancement layer 223*a* and the horizontal barrier ribs 224*a* may be different from each other. Here, a roughness may indicate the porosity of the horizontal barrier ribs 224*a* and the horizontal discharge enhancement layer 223*a* as end products. That is, as porosity increases, a roughness increases.

Referring back to FIG. 2, more phosphors can be formed on a top surface C and projecting edges B by making the roughness of the top surface C of the horizontal discharge enhancement layer 223*a* greater than the roughness of each of the horizontal barrier ribs 224*a*. A method of manufacturing the horizontal and vertical discharge enhancement layers 223*a* and 223*b* and the horizontal and vertical barrier ribs 224*a* and 224*b* will be explained later in more detail when a method of manufacturing the PDP is described.

Referring to FIG. 5, the second material for the horizontal and vertical discharge enhancement layers 223*a* and 223*b* of the discharge enhancement layer 223 may have a suitable brightness that is greater than that of the first material for the horizontal and vertical barrier ribs 224*a* and 224*b* of the barrier ribs 224. That is, the second material may have a reflectance of visible light that is greater than that of the first material. Accordingly, more visible light emitted from a phosphor layer 225 toward a rear dielectric layer 221 may be reflected by the discharge enhancement layer 223 to a front dielectric layer 214, thereby improving luminous efficiency.

A phosphor layer 225 is formed on side surfaces of the horizontal and vertical barrier ribs 224*a* and 224*b*, the top surfaces C of the horizontal and vertical discharge enhancement layers 223*a* and 223*b*, and inner surfaces of openings (e.g., grooves) 223*aa* and 223*ba*. The phosphor layer 225 emits visible light when electrons of phosphor materials are excited by vacuum ultraviolet rays that are generated by a gas discharge during a sustaining discharge, and then the excited electrons are stabilized.

In one embodiment of the present invention, the horizontal discharge enhancement layer 223*a* is not formed or present in the non-discharge cells G' of the PDP of FIG. 4 because, when phosphors are dispensed to the discharge cells G and the non-discharge cells G', the phosphors may overflow the non-discharge cells G' due to the discharge enhancement layer formed in the non-discharge cells G'.

Figure 6:
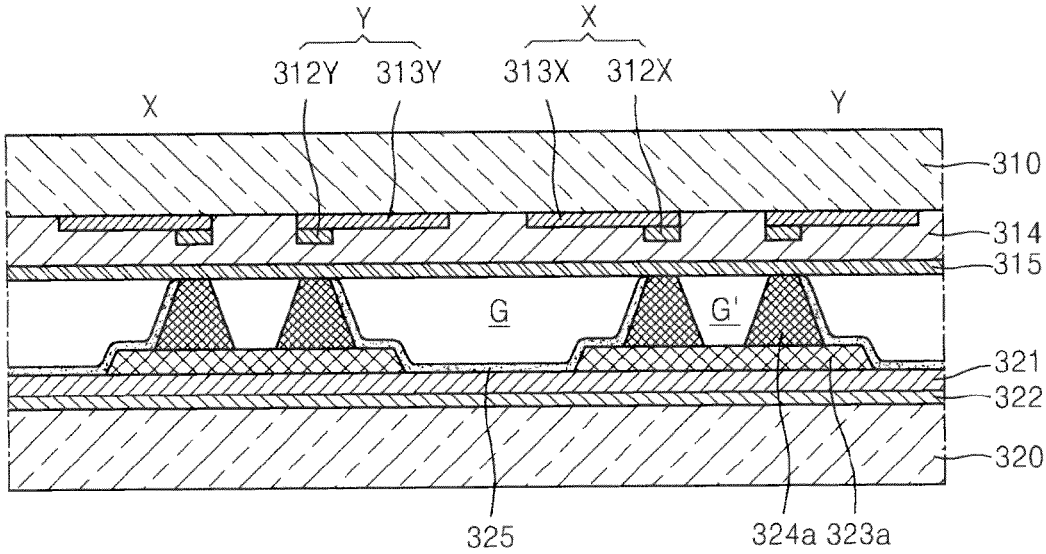
FIG. 6 is a cross-sectional schematic view illustrating a modification of the PDP of FIG. 4 according to an embodiment of the present invention.

However, a discharge enhancement layer 323*a* may be formed in the non-discharge cells G as shown in an embodiment in FIG. 6, in which phosphors are not applied to the non-discharge cells G' of the PDP.

Figure 7A:
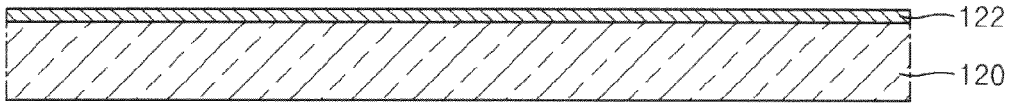
FIGS. 7A, 7B, 7C, 7D, 7E, 7F, 7G, 7H and 7I are cross-sectional schematic views illustrating a method of manufacturing a rear substrate of the PDP of FIG. 1, according to an embodiment of the present invention.

FIGS. 7A through 7I are cross-sectional schematic views illustrating a method of manufacturing the PDP of FIG. 1, according to an embodiment of the present invention. Referring to FIG. 7A, the address electrodes 122 are formed on the rear substrate 120 that is formed of glass. The address electrodes 122 may be formed by any suitable methods such as pattern printing, photolithography utilizing a photosensitive paste, and lift-off.

Figure 7B:
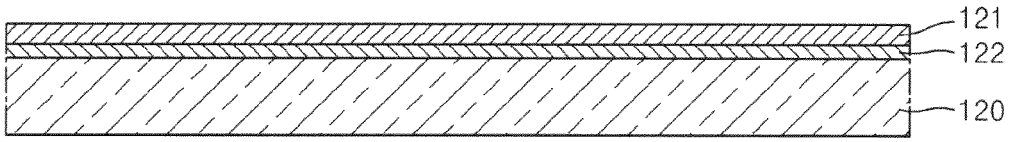

Referring to FIG. 7B, the rear dielectric layer 121 is formed on the rear substrate 120 including the address electrodes 122. The rear dielectric layer 121 may be formed by suitable whole surface printing. The rear dielectric layer 121 may be formed of a suitable white or near white material in order to reflect visible light generated by phosphors to the front dielectric layer 114.

Figure 7C:
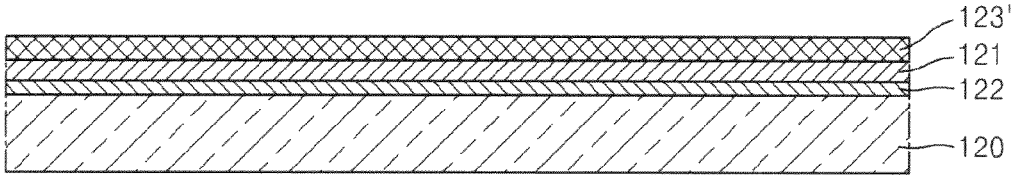
Figure 7D:
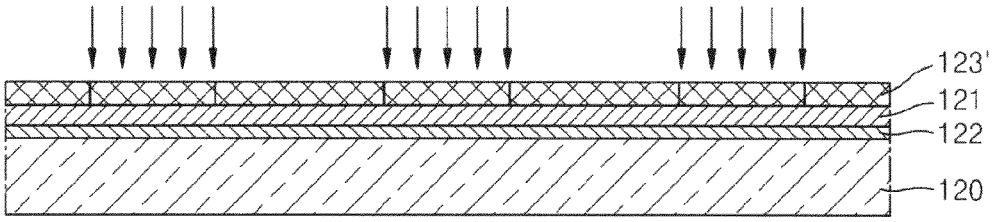

Referring to FIG. 7C, a first material 123' for forming the discharge enhancement layer 123 is coated and dried on the rear dielectric layer 121. Referring to FIG. 7D, the first material layer 123' is exposed to light such as UV light through a set or predetermined pattern mask. The first material 123' may be a photosensitive material and exposed portions of the first material layer 123' after reacting to light are removed during development. In this case, the exposed portions may correspond to the openings 123*aa* and 123*ba* of the discharge enhancement layer 123. Alternatively, the first material 123' is a photosensitive material and exposed portions of the first material layer 123' after reacting to light are not to be removed during development. In this case, unexposed portions of the first material layer 123' correspond to the openings 123*aa* and 123*ba* of the discharge enhancement layer 123.

Figure 7E:
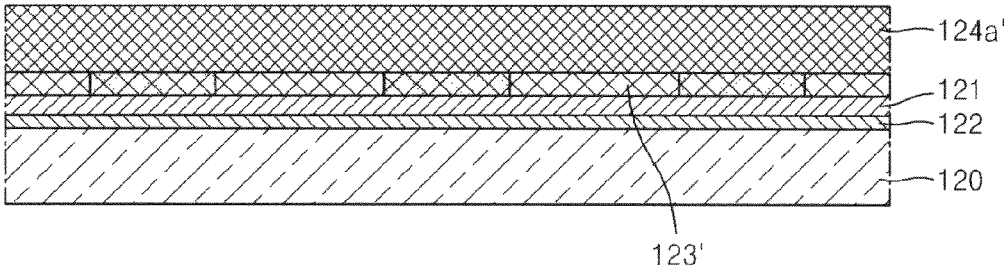

Referring to FIG. 7E, a second material 124*a*' for the horizontal and vertical barrier ribs 124*a* and 124*b* of the barrier ribs 124 is coated and dried on the first material 123' resulting in a structure.

Figure 7F:
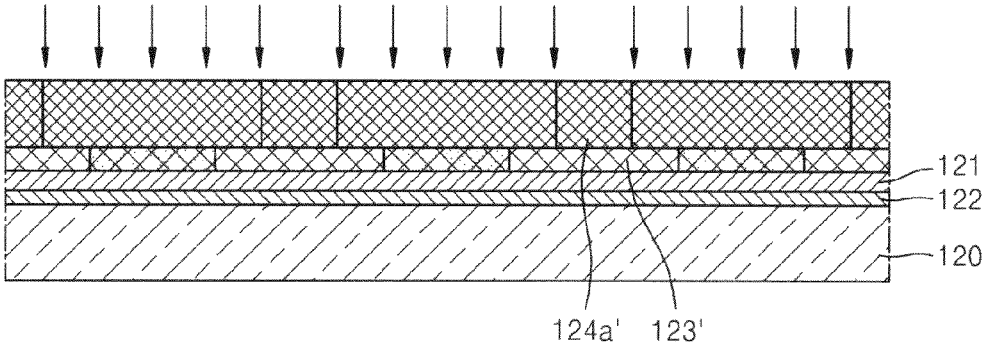

Referring to FIG. 7F, the second material layer 124*a*' is exposed to light such as UV light through a predetermined pattern mask. Here, the second material layer 124*a*' may be formed of a photosensitive material, and exposed portions of the second material after reacting to light are removed during development. In this case, the exposed portions may correspond to discharge spaces. Alternatively, the second material layer 124*a*' is formed of a photosensitive material, and exposed portions of the second material layer 124' after reacting to light are not to be removed during development. In this case, the exposed portions correspond to the horizontal and vertical barrier ribs 124*a* and 124*b* of the barrier ribs 124.

Figure 7G:
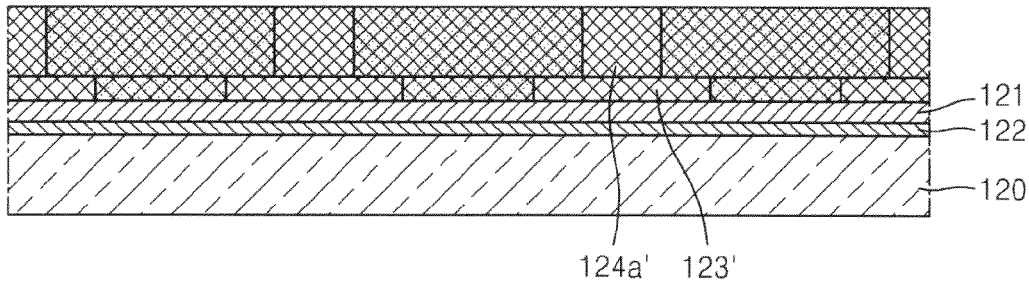
Figure 7H:
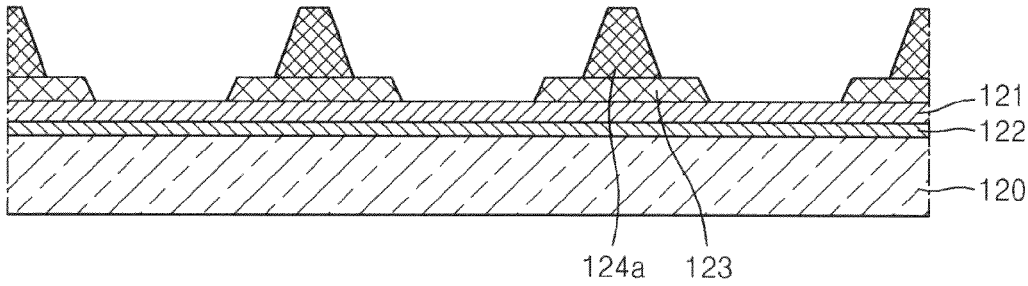

Referring to FIG. 7G, the discharge enhancement layer 123*a* and the horizontal barrier ribs 124*a* which are exposed to light are stacked. Referring to FIG. 7H, a suitable developer is applied to the discharge enhancement layer 123 and the horizontal barrier ribs 124*a*. The slope of each of the side surfaces of each of the horizontal and vertical discharge enhancement layers 123*a* and 123*b* may be suitably adjusted according to: a temperature at and a time for which the first material layer 123' for forming the horizontal and vertical discharge enhancement layers 123*a* and 123*b* is dried; and exposure conditions such as the light source, the amount of light utilized for exposure, the exposure distance, and the mask material. Likewise, the slope of each of the horizontal barrier ribs 124*a* and the vertical barrier ribs 124*b* may be suitably adjusted according to a temperature at which the second material layer 124*a*' for forming the horizontal and vertical barrier ribs 124*a* and 124*b* is dried and the amount of light used for exposure.

In addition, a baking (or firing) process is performed. The porosity of each of the horizontal and vertical barrier ribs 124*a* and 124*b* and the horizontal and vertical discharge enhancement layers 123*a* and 123*b* may be changed according to a baking temperature. For example, as the baking temperature increases, the porosity and the roughness of each of the horizontal and vertical barrier ribs 124*a* and 124*b* and the horizontal and vertical discharge enhancement layers 123*a* and 123*b* decrease. On the other hand, as the baking temperature decreases, the porosity and the roughness of each of the horizontal and vertical barrier ribs 124*a* and 124*b* and the horizontal and vertical discharge enhancement layers 123*a* and 123*b* increase.

Figure 7I:
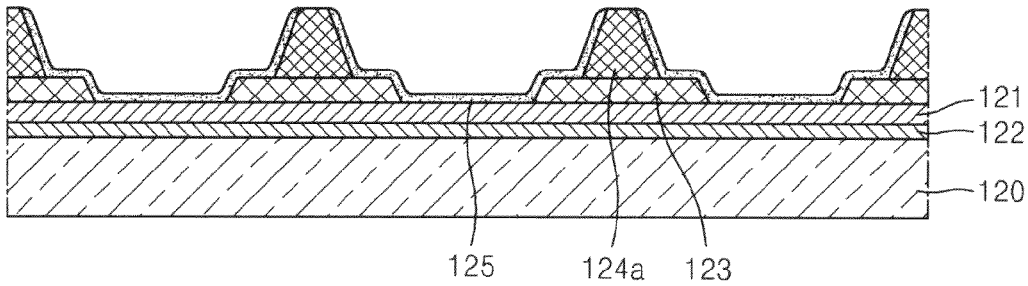

Referring to FIG. 7I, the phosphor layer 125 is formed in the discharge spaces on the rear substrate 120 including the rear dielectric layer 121, the horizontal and vertical discharge enhancement layers 123*a* and 123*b*, and the horizontal and vertical barrier ribs 124*a* and 124*b*. For example, a red (R) phosphor may be applied by dispensing an R phosphor paste to R discharge cells through nozzles, followed by drying and baking or only baking the R phosphor paste. Likewise, a green (G) phosphor and a blue (B) phosphor may be sequentially applied to G discharge cells and B discharge cells. For example, the phosphor layer 225 of the PDP of FIG. 4 is formed in both the discharge cells G and the non-discharge cells G'. However, the present invention is not limited thereto, and the phosphor layer 125 or 225 may be formed in suitable alternative ways.

Alternatively, an R phosphor may be applied by rolling an R phosphor paste through a printing mask conforming to discharge spaces of R discharge cells, followed by drying and baking or only baking the R phosphor paste. Likewise, a G phosphor and a B phosphor may be applied sequentially or concurrently to G discharge cells and B discharge cells. For example, a phosphor layer 325 of a PDP of FIG. 6, which is a modification of the PDP of FIG. 4, is formed only inside the discharge cells G.

Figure 8A:
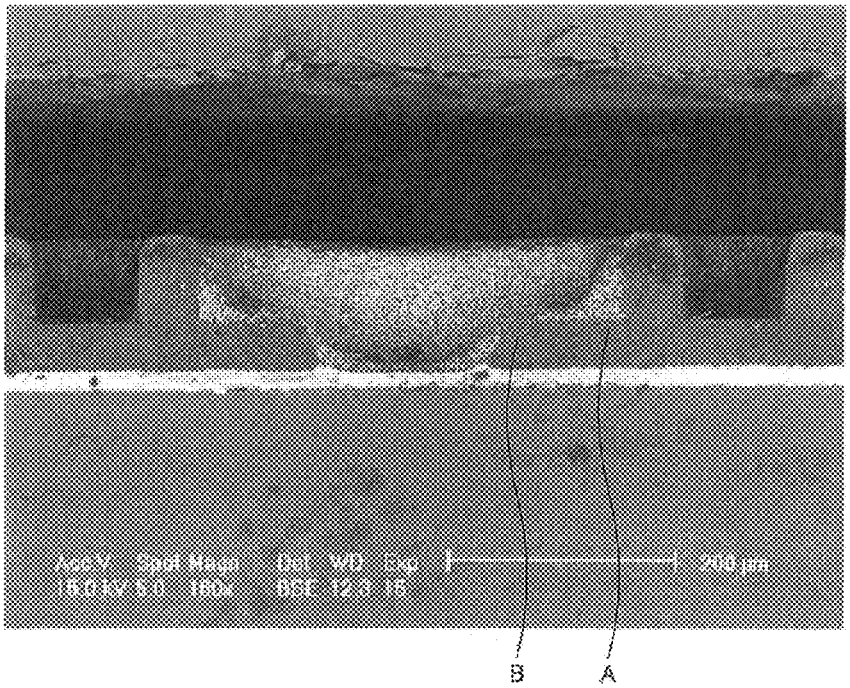
FIG. 8A is a scanning electron microscope (SEM) image and a cross-sectional view of a phosphor layer of a PDP that is manufactured to include discharge cells defined by both barrier ribs and a discharge enhancement layer.

FIG. 8A is a scanning electron microscope (SEM) image and a cross-sectional view of a phosphor layer of a PDP that includes discharge cells defined by both barrier ribs and discharge enhancement layers. Referring to FIG. 8A, the largest amount of phosphors are formed on side surfaces A of horizontal barrier ribs, a smaller amount of phosphors are formed on a top surface of the discharge enhancement layer, and the least amount of phosphors are formed on projecting edges B of side surfaces of openings.

The top surface of the discharge enhancement layer and the projecting edges B, which are close to common electrodes X and scan electrodes Y that generate a sustaining discharge, greatly affect the light extraction efficiency of phosphors. Since the thickness of phosphors on the top surface of the discharge enhancement layer and the projecting edges B is low, luminous efficiency is reduced.

Figure 8B:
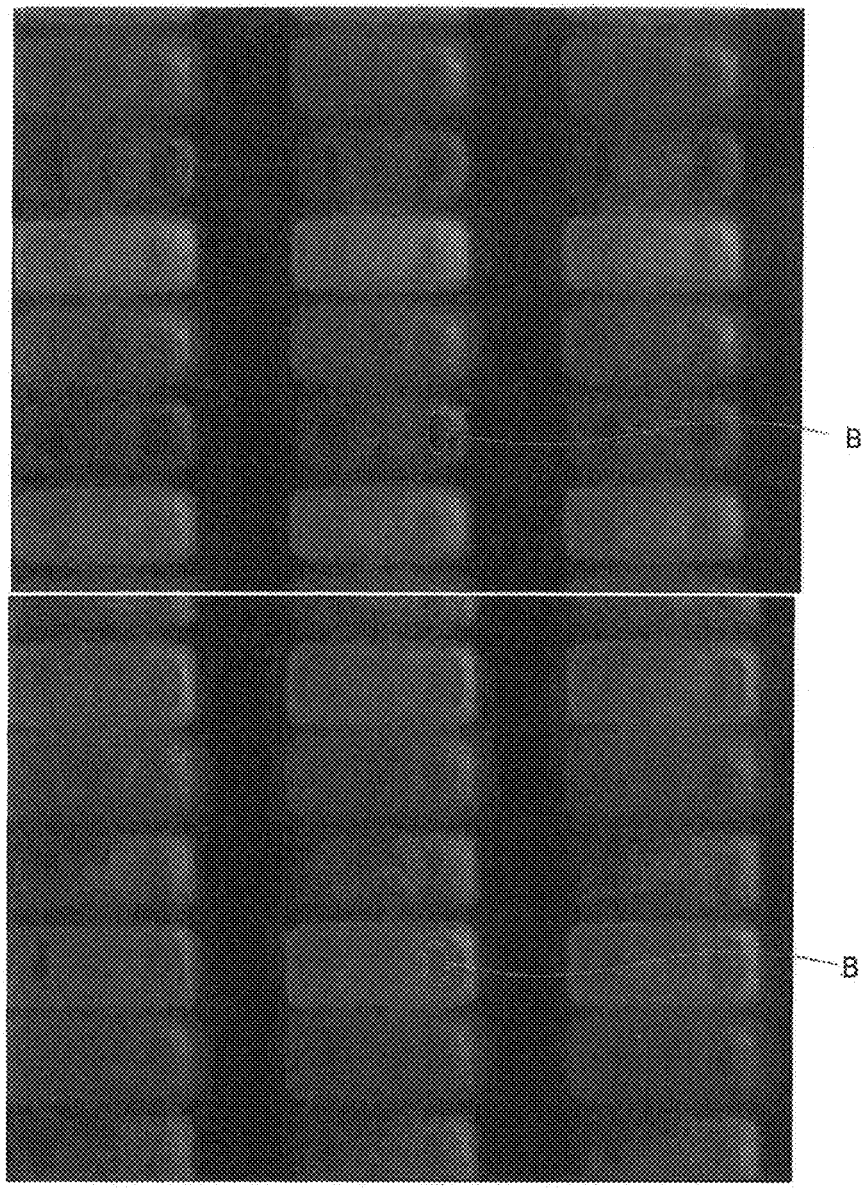
FIG. 8B is a top plan view of the discharge cells of FIG. 8A.

FIG. 8B is a top plan view of the discharge cells of FIG. 8A. Referring to FIG. 8B, since the least amount of phosphors are formed on or near the projecting edges B, a local brightness difference or variation within each discharge cell is apparent, and a light reflectance difference is also caused within the discharge cell. Hence, it is important to uniformly apply phosphors on inner surfaces of the discharge cells of the PDP which are defined by the barrier ribs and the discharge enhancement layer.

Figure 9:
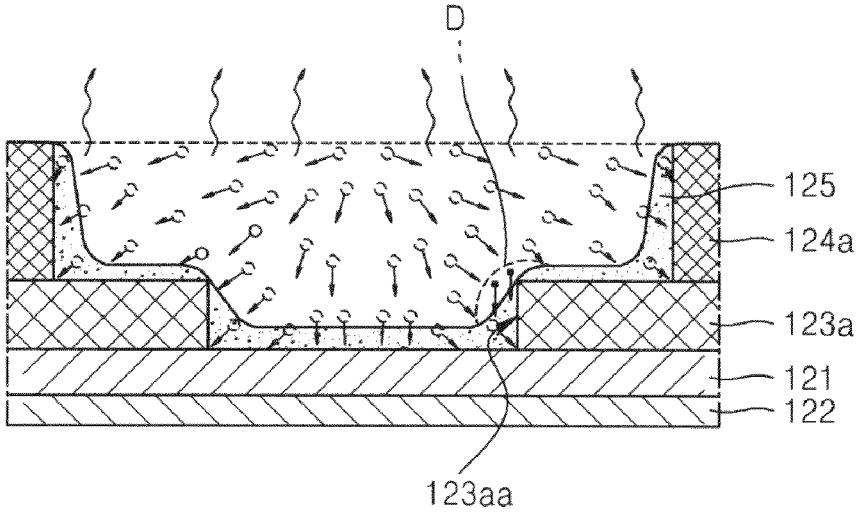
FIG. 9 is a cross-sectional schematic view illustrating a case where a phosphor paste is applied to the discharge cells defined by the barrier ribs and the discharge enhancement layer of the PDP of FIG. 8A, and a phosphor layer is formed through drying and baking (firing) or only through firing.

FIG. 9 is a cross-sectional schematic view illustrating a phosphor paste applied to the discharge cells defined by the barrier ribs and the discharge enhancement layer of the PDP of FIG. 8A and a resulting phosphor layer formed through drying and baking or firing or only through baking or firing. The reason why the least amount of phosphors is formed on the projecting edges B of the discharge enhancement layer after the phosphor paste is applied to the discharge cells followed by drying and baking or firing or only through baking or firing the phosphor paste will now be explained in more detail with reference to FIG. 9.

After the phosphor paste is applied to inner surfaces of the discharge cells by utilizing a dispensing process or a screen printing process, the phosphor paste is dried and baked, or only baked. During the baking process, a solvent in the phosphor paste is evaporated, causing the phosphor paste to shrink, and the remaining phosphor paste vehicles are accumulated on the surfaces of the discharge cells. However, since a small amount of the phosphor paste is left on the projecting edges B of the discharge enhancement layer due to the weight of the phosphor paste and the attractive force of part of the phosphor paste in the openings, the thickness of the phosphors applied to the projecting edges B of the discharge enhancement layer is very small.

Once the rear panel is completely manufactured by the method of FIGS. 7A through 7I, the front panel and the rear panel are sealed to each other, and an impure gas or air is removed from the discharge cells sealed between the panels. Then, a suitable discharge gas is injected into each of the discharge cells, thereby completing the manufacturing of the PDP. Here, a suitable method of manufacturing the front panel is utilized.

The functions, operations, and effects of certain elements of the PDP will now be explained in more detail.

Referring back to FIGS. 1-3, since an addressing discharge occurs between the scan electrode Y and each of the address electrodes 122, the horizontal and vertical discharge enhancement layers 123*a* and 123*b* and the front dielectric layer 114 or the protective layer 115 covering the scan electrode Y become facing discharge surfaces, and an addressing discharge concentrates in the auxiliary discharge space S1. That is, a discharge electric field is concentrated in the auxiliary discharge space S1 due to high dielectric constants of the horizontal and vertical discharge enhancement layers 123*a* and 123*b* formed on each of the address electrodes 122 and of the front dielectric layer 114 covering the scan electrode Y, and an opposed discharge occurs between a rear surface of the front dielectric layer 114 and the top surface C of each of the horizontal and vertical discharge enhancement layers 123*a* and 123*b* which face each other with the auxiliary discharge space S1 therebetween. While an addressing discharge would be generated between the scan electrode Y and each of the address electrodes 122 through a long discharge path corresponding to the height of the discharge cells in a conventional art, according to the embodiments of the present invention, a discharge path between the scan electrode Y and each of the address electrodes 122 is shortened, and an electric field between an edge of the scan electrode Y and the discharge enhancement layer 123 is strong, thereby generating a fast and strong discharge. Accordingly, since the PDP and the method of manufacturing the same according to the embodiments of the present invention can produce the same number of priming particles with a lower address voltage as compared to the conventional art, driving power consumption can be reduced. Moreover, since the PDP and the method of manufacturing the same according to the embodiments of the present invention can produce more priming particles with the same address voltage as compared to the conventional art, luminous efficiency can be improved.

The openings 123*aa* and 123*ba* are formed in portions of the horizontal and vertical discharge enhancement layers 123*a* and 123*b*, respectively, corresponding to the centers of the discharge cells. Due to the openings 123*aa* and 123*ba*, some portions of the horizontal and vertical discharge enhancement layers 123*a* and 123*b* are projected or protruded, such that an effective surface area to which the phosphor layer 125 is applied increases. Hence, the amount of light converted into visible light due to vacuum ultraviolet rays that are produced during a sustaining discharge increases, and thus luminous efficiency can be improved.

In the above described embodiment, phosphors can be uniformly formed in the discharge cells, an address voltage can be reduced, and an effective surface area on which the phosphor layer 125 is formed increases due to the horizontal and vertical discharge enhancement layers 123*a* and 123*b*. In one embodiment, according to results of simulations performed by the inventors of the present invention, the light extraction efficiency of the PDP, including the discharge cells that are defined by the barrier ribs 124 and the horizontal and vertical discharge enhancement layers 123*a* and 123*b* including the openings 123*aa* and 123*ba*, is 29.25%, which is obtained without considering the thickness of the phosphor layer 125, whereas the light extraction efficiency of the same PDP is 26.72%, which is obtained with the thickness of the phosphor layer 125 taken into consideration. Accordingly, it is found that the thickness of the phosphor layer 125 formed in the discharge cells should be uniform above a suitable thickness.

To this end, the horizontal barrier ribs 124*a* have a roughness that is less than that of the top surface C of the horizontal discharge enhancement layer 123*a*. As a roughness decreases, porosity decreases and the degree of limiting the mobility of the phosphor paste decreases. Accordingly, a larger amount of the phosphor paste, which would have been formed on the side surfaces of the horizontal barrier ribs 124*a* as described above with reference to FIG. 8A, is moved toward and formed on the top surface C of the horizontal discharge enhancement layer 123*a*. Since the top surface C of the horizontal discharge enhancement layer 123*a* is oriented horizontally during a process of forming the phosphor layer 125 and the roughness of the horizontal discharge enhancement layer 123*a* is relatively high, a considerable amount of the phosphor paste is left on the top surface C of the horizontal discharge enhancement layer 123*a*. Accordingly, the phosphor layer 125 formed on the top surface C of the horizontal discharge enhancement layer 123*a* has a higher thickness and better thickness uniformity than that of the PDP having the structure of FIG. 8A.

If the width W1 of the top surface C of the horizontal discharge enhancement layer 123*a* increases, even though the roughness of the horizontal discharge enhancement layer 123*a* is very low, a considerable amount of the phosphor paste is left on the top surface C of the horizontal discharge enhancement layer 123*a*. However, if the width W1 of the front surface C of the horizontal discharge enhancement layer 123*a* increases, a sustaining discharge voltage generally increases, and the amount of the phosphor layer 125 formed on the rear dielectric layer 121 is reduced, thereby lowering luminous efficiency. Accordingly, in one embodiment of the present invention, a ratio of the width W1 of the top surface C of the horizontal discharge enhancement layer 123*a* to the width L1 of the discharge cells in the vertical direction is maintained at an appropriate level, for example, between 20% and 33%. However, the present invention is not limited thereto.

Each side surfaces of each of the openings 123*aa* of the horizontal discharge enhancement layer 123*a* has a set or predetermined slope at an angle $\alpha$ with respect to a surface substantially perpendicular to the first substrate or the second substrate. Accordingly, the weight of the phosphor paste on the projecting edges B of the horizontal discharge enhancement layer 123*a* is divided into a vertical weight and a horizontal weight. As such, the vertical weight is reduced, and thus more phosphors may be formed on the projecting edges B. Also, since the roughness of the top surface C of the horizontal discharge enhancement layer 123*a* is relatively high, a force resisting the movement of the phosphor paste against the attractive force of the phosphor paste in the openings 123*aa* increases, therefore more phosphors may be formed on the projecting edges B.

The inventors have found that as the slope of the phosphor layer 125 increases, light extraction efficiency increases. That is, the slope of the phosphor layer 125 greatly affects light extraction efficiency. However, since the slope of the phosphor layer 125 varies according to where light extraction efficiency is measured in each discharge cell, instead of the slope of the phosphor layer 125, the slope of each of the horizontal barrier ribs 124*a* and the slope of each of the side surfaces of each of the openings 123*aa* of the discharge enhancement layer 123 will be utilized to describe and/or configure the embodiment of the present invention because the slope of the phosphor layer 125 is highly interrelated to the slope of each of the horizontal barrier ribs 124*a* and the slope of each of the side surfaces of each of the openings 123*aa* of the discharge enhancement layer 123.

Figure 10:
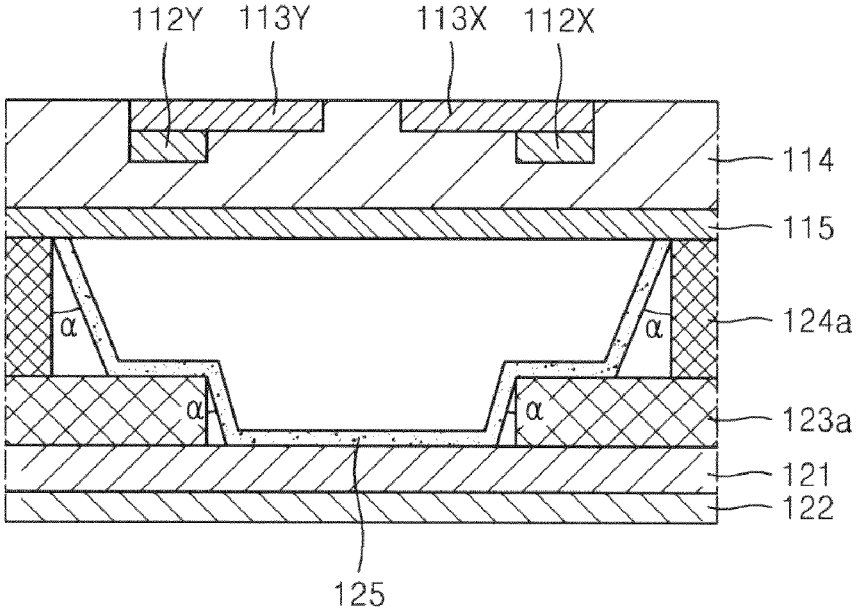
FIG. 10 is a cross-sectional schematic view of the PDP of FIG. 1 that is used in simulations for examining a change in light extraction efficiency according to the slope of the phosphor layer.
Figure 11:
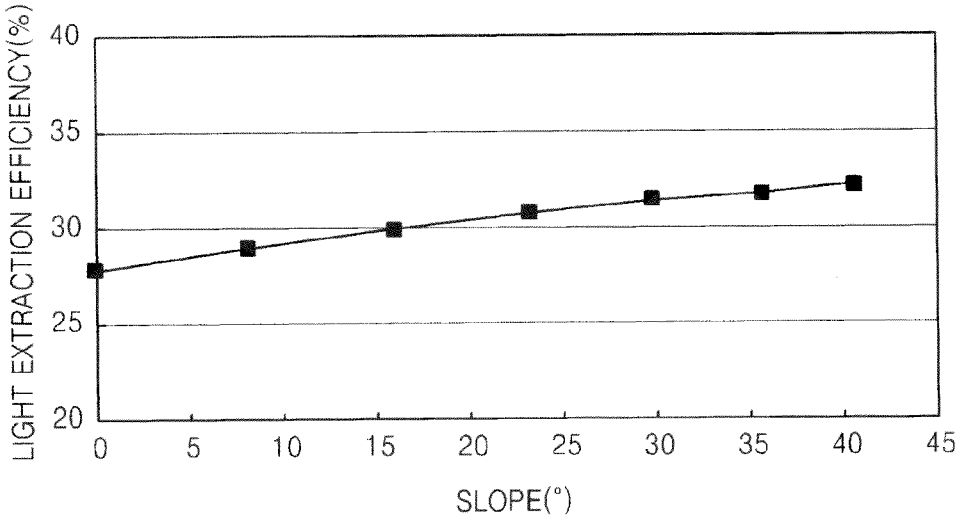
FIG. 11 is a graph illustrating a relationship between light extraction efficiency and the slope of the phosphor layer applied to the PDP of FIG. 10.
Figure 12:
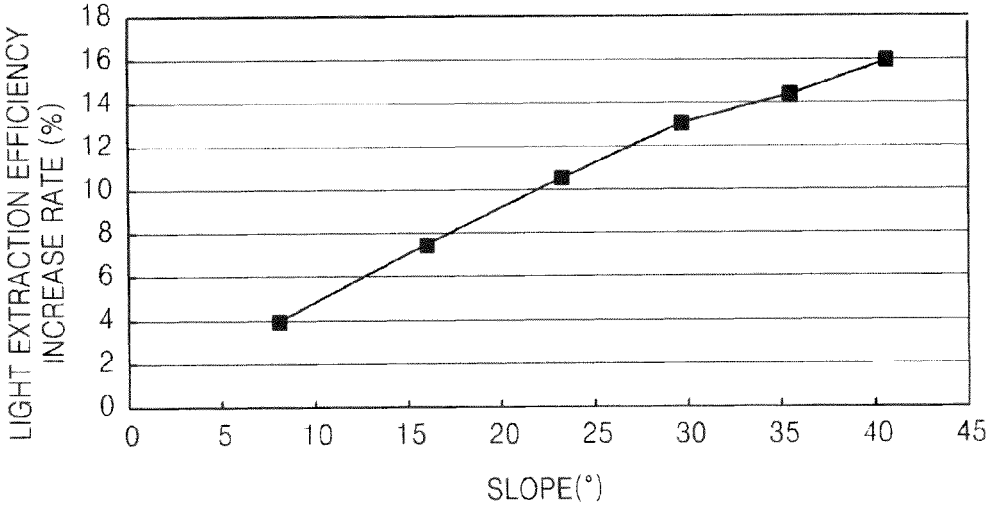
FIG. 12 is a graph illustrating a relationship between a light extraction efficiency increase rate and the slope of the phosphor layer applied to the PDP of FIG. 10.

FIGS. 11 and 12 are graphs illustrating simulation results showing a relationship between light extraction efficiency and the slope of each of the horizontal barrier ribs 124*a* and the slope of each of the side surfaces of the horizontal discharge enhancement layer 123*a*, and a light extraction efficiency increase rate and the slope of each of the horizontal barrier ribs 124*a* and the slope of each of the side surfaces of the horizontal discharge enhancement layer 123*a* of the PDP having the structure of FIG. 10, respectively.

Referring to FIG. 11, as the slope of each of the horizontal barrier ribs 124*a* and the slope of each of the side surfaces of the horizontal discharge enhancement layer 123*a* increase, light extraction efficiency, which is a ratio of vacuum ultraviolet rays converted into visible light to total generated vacuum ultraviolet rays, increases proportionally. Referring to FIG. 12, as the slope of each of the horizontal barrier ribs 124*a* and the slope of each of the side surfaces of the horizontal discharge enhancement layer 123*a* increase, a light extraction efficiency increase rate increases. Although not illustrated in FIG. 12, a light extraction efficiency increase rate of the PDP including the discharge enhancement layer 123 having the openings 123*aa* and 123*ba* is higher than a light extraction efficiency increase rate of the PDP without the discharge enhancement layer 123 having the openings 123*aa* and 123*ba*. Accordingly, since the slope of the phosphor layer 125 of the PDP including the discharge cells that are defined by the horizontal and vertical barrier ribs 124*a* and 124*b* and the horizontal and vertical discharge enhancement layers 123*a* and 123*b* greatly affects light extraction efficiency, it is beneficial to suitably increase the slope of each of the horizontal barrier ribs 124*a* and the slope of each of the side surfaces of the horizontal discharge enhancement layer 123*a*. However, it is not desirable to infinitely increase the slope of each of the horizontal barrier ribs 124*a* and the slope of each of the side surfaces of the horizontal discharge enhancement layer 123*a* because as the slope of the horizontal barrier ribs 124*a* increases and the slope of each of the side surfaces of the horizontal discharge enhancement layer 123*a* increases, a discharge space is reduced and a sustaining discharge path during a sustaining discharge is reduced due to interference. That is, if the slope is too steep, an unstable discharge may occur and a poor discharge, such as a low discharge, may be generated. In one embodiment of the present invention, considering such an unstable discharge, the angle of the slope of each of the side surfaces of each of the openings 123*aa* of the horizontal discharge enhancement layer 123*a* does not exceed 30°.

The second material for the horizontal and vertical discharge enhancement layers 123*a* and 123*b* may have a brightness that is greater than that of the first material for forming the horizontal and vertical barrier ribs 124*a* and 124*b*. That is, if the second material is brighter than the first material, a light reflectance of the second material is higher than that of the first material. Accordingly, visible light emitted from the phosphor layer 125 and transmitted backward will be reflected and transmitted forward, thereby improving luminous efficiency.

While the present invention has been particularly shown and described with reference to exemplary embodiments thereof, it will be understood by one of ordinary skill in the art that various changes in form and details may be made therein without departing from the spirit and scope of the present invention as defined by the following claims, and equivalents thereof.

What is claimed is:

1. A plasma display panel comprising:

a first substrate;

a second substrate facing the first substrate;

a plurality of sustain electrode pairs between the first substrate and the second substrate and extending in a first direction;

a plurality of address electrodes on the second substrate and extending in a second direction crossing the first direction of the sustain electrode pairs;

a first dielectric layer on the second substrate for covering the plurality of address electrodes;

a discharge enhancement layer on the first dielectric layer;

a plurality of barrier ribs on the discharge enhancement layer, and defining discharge cells between the first substrate and the second substrate; and phosphor layers in the discharge cells and being in contact with a topmost surface of the discharge enhancement layer, the topmost surface facing oppositely away from the second substrate, wherein the discharge enhancement layer has an opening in each of the discharge cells, and wherein the barrier ribs have a roughness less than that of the discharge enhancement layer.

2. The plasma display panel according to claim 1, wherein a distance between two adjacent ones of the barrier ribs facing each other in a direction parallel to a surface of the first substrate or the second substrate is greater than a width of a corresponding one of the openings.

3. The plasma display panel according to claim 1, wherein the discharge enhancement layer has a brightness greater than that of the barrier ribs.

4. The plasma display panel according to claim 1, wherein the discharge enhancement layer has a reflectance greater than that of the barrier ribs.

5. The plasma display panel according to claim 1, wherein the phosphor layers are on side surfaces of the barrier ribs and in the openings.

6. The plasma display panel according to claim 1, wherein a width of each of the openings tapers toward the first dielectric layer.

7. The plasma display panel according to claim 1, wherein the distance between two adjacent ones of the barrier ribs tapers toward the first dielectric layer.

8. The plasma display panel according to claim 1, wherein a side surface of the discharge enhancement layer defining one of the openings has a slope at an angle between about 7° and about 30° with respect to a surface substantially perpendicular to the first substrate or the second substrate.

9. The plasma display panel according to claim 1, wherein each of the sustain electrode pairs comprises an X electrode and a Y electrode on the first substrate, the X electrode and the Y electrode being spaced apart from each other.

10. The plasma display panel according to claim 1, further comprising:

a second dielectric layer on the first substrate and covering the sustain electrode pairs; and a protective layer on the second dielectric layer.

11. The plasma display panel according to claim 1, wherein a portion of the topmost surface of the discharge enhancement layer in a first discharge cell of the discharge cells has a first width extending in the first direction and a second width extending in the second direction, the first and second directions being parallel to the first substrate or the second substrate, and wherein a ratio of the first width to a width of the first discharge cell extending in the first direction is greater than a ratio of the second width to another width of the first discharge cell extending in the second direction, the first and second directions being substantially perpendicular to each other.

12. The plasma display panel according to claim 1, wherein the barrier ribs comprise first barrier ribs extending in the first direction and second barrier ribs extending in the second direction.

13. The plasma display panel according to claim 12, wherein the first barrier ribs and the second barrier ribs define only the discharge cells.

14. The plasma display panel according to claim 12, wherein the first barrier ribs and the second barrier ribs define the discharge cells and non-discharge cells between the first substrate and the second substrate.

15. The plasma display panel according to claim 14, wherein the openings of the discharge enhancement layer in the respective discharge cells have rounded corners.

16. The plasma display panel according to claim 14, wherein a curvature of corners of the openings in the discharge cells is different from that of other openings of the discharge enhancement layer in the non-discharge cells.

17. The plasma display panel according to claim 14, wherein a curvature of corners of the openings in the discharge cells is smaller than that of other openings of the discharge enhancement layer in the non-discharge cells.

18. The plasma display panel according to claim 14, wherein the discharge enhancement layer has other openings in the non-discharge cells.

19. The plasma display panel according to claim 18, wherein the phosphor layers are in contact with the first dielectric layer in the non-discharge cells via the other openings.

20. The plasma display panel according to claim 14, wherein the discharge enhancement layer has no opening in the non-discharge cells.

21. The plasma display panel according to claim 20, wherein the phosphor layers are not in the non-discharge cells.

* * * * *